United States Patent [19]

Adachi

[11] Patent Number: 4,913,128

[45] Date of Patent: Apr. 3, 1990

[54] BURNER APPARATUS

[75] Inventor: Ikuro Adachi, Aichi, Japan

[73] Assignee: Rinnai Corporation, Aichi, Japan

[21] Appl. No.: 328,810

[22] Filed: Mar. 23, 1989

Related U.S. Application Data

[63] Continuation of Ser. No. 36,216, Apr. 9, 1987, abandoned.

[30] Foreign Application Priority Data

Apr. 23, 1986 [JP] Japan ..... 61-94356

[51] Int. Cl.[4] ..... F24H 1/00; F24N 5/10

[52] U.S. Cl. ..... 126/351; 431/12; 431/29; 431/89; 431/90; 122/448 R

[58] Field of Search ..... 431/6, 12, 75, 76, 80, 431/90, 29; 126/351; 122/448 R

[56] References Cited

U.S. PATENT DOCUMENTS

| | | | |
|---|---|---|---|
| 4,329,138 | 5/1982 | Riordan | 431/90 |
| 4,588,372 | 3/1986 | Torborg | 431/78 |
| 4,622,004 | 11/1986 | Dalhuisen | 431/76 |
| 4,622,005 | 11/1986 | Kuroda | 431/78 |

FOREIGN PATENT DOCUMENTS

| | | | |
|---|---|---|---|
| 2708858 | 9/1978 | Fed. Rep. of Germany | 431/90 |
| 0175718 | 10/1983 | Japan | 431/90 |
| 0224226 | 12/1983 | Japan | 431/90 |
| 783943 | 10/1957 | United Kingdom | 431/90 |
| 2075718 | 11/1981 | United Kingdom | 431/90 |

*Primary Examiner*—Carl D. Price

*Attorney, Agent, or Firm*—Nilsson, Robbins, Dalgarn, Berliner, Carson & Wurst

[57] ABSTRACT

A burner apparatus comprising: a burner plate, a proportional directional valve through which fuel gas flows into said burner plate, a blower which supplies air to said burner plate, a thermal sensor which detects the burning condition of said burner plate, a heat determining means which determines the heat generation of said burner plate, a blower control circuit which controls said blower in response to the condition of said heat determining means, a proportional directional valve control circuit which controls the opening degree of said proportional directional valve in response to the output of said thermal sensor and the amount of air flow from said blower.

3 Claims, 4 Drawing Sheets

FIG. 2
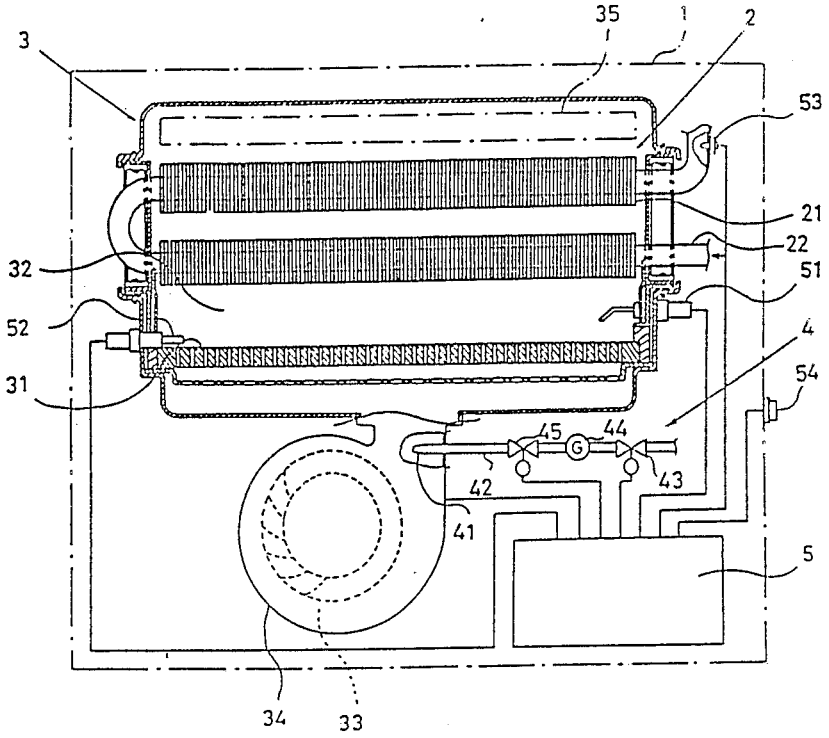
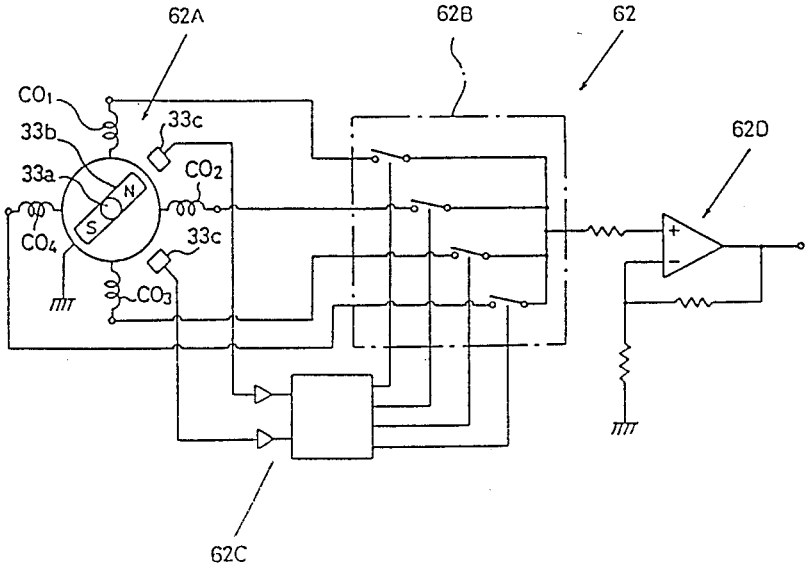
FIG. 3

BURNER APPARATUS

PRIORITY CLAIM

This application claims priority under 35 USC 119 from Japanese Patent Application Ser. No. 94356/1986, filed Apr. 23, 1986.

This is a continuation of co-pending application Ser. No. 07/036,216 filed on Apr. 9, 1987, now abandoned.

FIELD OF THE INVENTION

The present invention relates to a burner apparatus in which fuel gas is fed through a proportional directional valve whose degree of openness is controlled by signals corresponding to the number of revolutions of a blower, and is particularly concerned with a burner improved so as to control both blower and proportional directional valve simultaneously in response to a heat adjustment operation.

BACKGROUND OF THE INVENTION

In a burner apparatus such as a water heater and room warming device, flammable gas or vaporized kerosene is fed through a proportional direction valve in response to a blower condition signal at the time of ignition.

At this time, the proportional directional valve determines the feeding amount of fuel in response to a heat adjustment operation. On the other hand, a thermal sensor is provided to detect the condition of flame so as to control the blower in association with the output from the thermal sensor.

In this instance, the proportional directional valve and the blower are individually controlled, so that when changing the feeding amount of air, the blower is controlled through the output of the thermal sensor in response to the heat adjustment operation. This results in very slow response of the blower to the heat adjustment operation. With this slow response the amount of air flow supplied becomes short in comparison with fuel gas so that normal combustion is hindered to generate toxic exhaust gas such as, for example, carbon monoxide.

SUMMARY OF THE INVENTION

It is an object of the present invention to provide a burner apparatus which is capable of ensuring a quick change of fuel supply in response to that of air supply when changing a heat determining means at any heat adjustment level.

According to the present invention, a blower control circuit is controlled in response to the output from a heat determining means, so that the amount of air flow from a blower is quickly adjusted.

On the other hand, a proportional directional valve control circuit is controlled in response to the amount of air flow from the blower, so that the opening degree of the proportional directional valve quickly follows the change of air flow. Due to the above facts, change of heat determining means quickly follows the amount of air flow from the blower and the opening degree of the proportional directional valve.

Meanwhile, the output from the thermal sensor works to compensate the opening degree of proportional directional valve so as to keep it at an appropriate degree for normal air-fuel ratio, even though an error signal is fed to the blower.

BRIEF DESCRIPTION OF THE DRAWINGS

Various other objects, features and attendant advantages of the present invention will be more fully appreciated as the same becomes better understood from the following detailed description when considered in conjunction with the accompanying drawings, in which like reference characters designate corresponding parts throughout the several views and wherein:

FIG. 2 is a schematic view of a water heater;

FIG. 3 is an electrical wiring diagram of a revolution detecting circuit;

DESCRIPTION OF THE PREFERRED EMBODIMENTS

Figure 1:
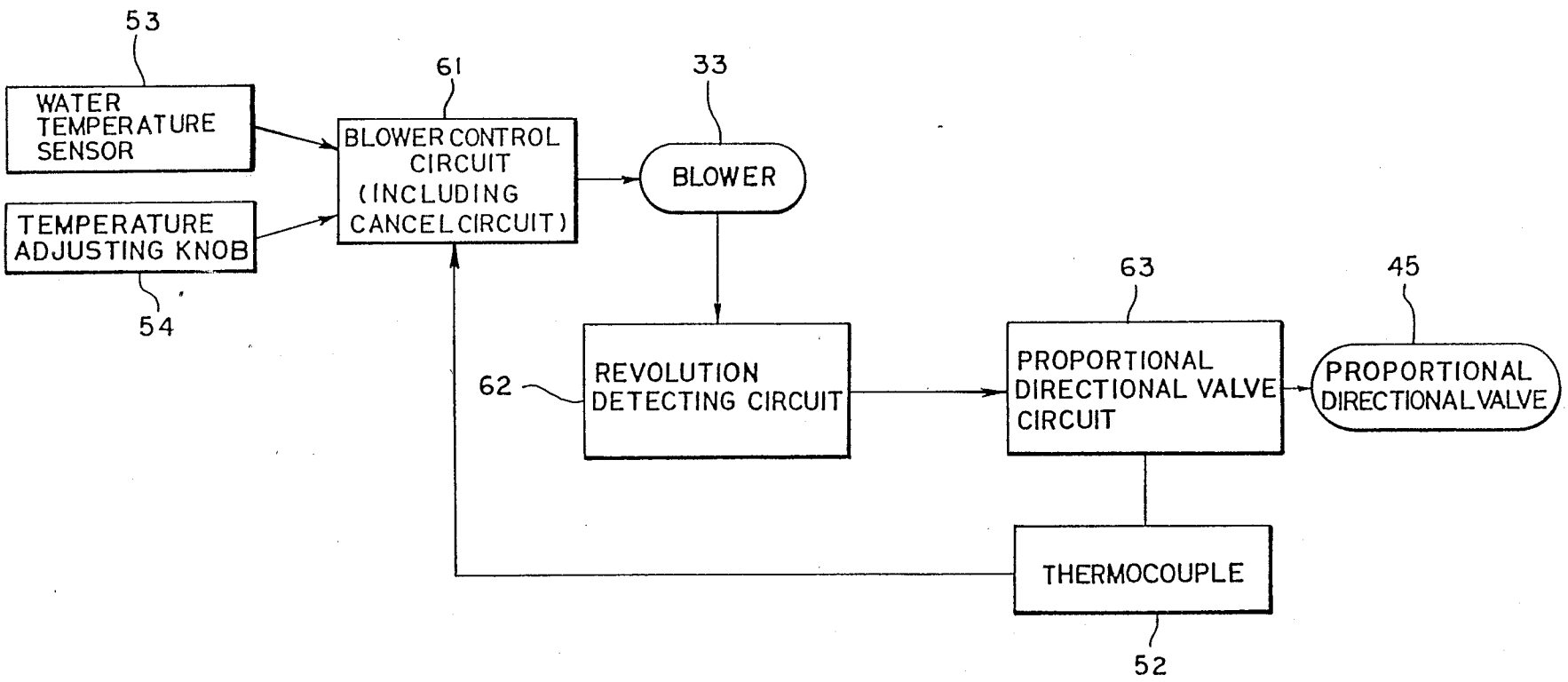
FIG. 1 is a block diagram of a control circuit according to a first embodiment of the invention.

Referring now to the drawings and more particularly to FIG. 2 thereof, in which a water heating device 1 is schematically shown, the heating device 1 incorporated with the present invention includes a burner portion 3 having a thermal exchanger 2, a flammable gas supply conduit 4, and an electronic control circuit 5. The burner portion 3 has a chamber 32 in which a ceramic burner 31 is placed. Under the chamber 32, there is provided an air supply portion 34 into which a blower 33 is incorporated. Above the chamber 32, there is provided an exhaust opening 35 through which exhaust gas from the burner 31 passes. The thermal exchanger 2 has a water conduit 22 carrying a series of fins 21, allowing heat to be imparted with the water flowing from the upper reach of the conduit 22 so as to supply hot water.

The gas supply conduit 4 has a nozzle 41 which ejects flammable gas through a gas supply pipe 42. At the upper reach of the gas supply pipe 42, a valve 43 is provided to be energized and deenergized for opening and closure. At the lower reach of the valve 43, a governor valve 44 is arranged to adjust flow of the fuel gas. A proportional directional valve 45 is disposed at the lower reach of the governor valve 44 to change its opening degree according to supplied electrical current.

An electronic control circuit 5 includes a pair of spaced electrodes 51 disposed on the burner plate 31 to build a spark therebetween at the time of igniting the gas. A thermocouple 52 is provided as a thermal sensor above the burner plate 31 to detect the air-fuel ratio by means of the electronic control circuit 5. A water temperature sensor 53 is attached to the water supply pipe 22 of the thermal exchanger 2 so as to be controlled by the electronic control circuit 5. The circuit 5 controls the temperature of the water coming from the supply pipe 22 of the thermal exchanger 2 when operated by means of a knob 54, so that a blower 33, valve 43 and a proportional directional valve 45 work as designed.

Reference is now made to FIG. 1 which shows how the degree of openness of the proportional directional valve 45 is controlled and how the amount of air flow of the blower 33 is controlled. According to FIG. 1, a blower control circuit 61 which acts as a temperature adjustment circuit is provided to adjust the temperature of hot water flowing through the supply pipe 22. This is accomplished by comparing output signal from the water temperature sensor 53 with the reference voltage from operation of the knob 54 to control the amount of energization against the blower 33. A revolution detecting circuit 62 is provided to detect the amount of air from the blower 33 by detecting the revolution of the blower 33. A proportional directional valve control circuit 63 is provided to control the amount of fuel gas by adjusting the opening degree of the proportional directional valve 45 in response to the outputs from the revolution detecting circuit 62 and that from the thermocouple 52.

Figure 4:
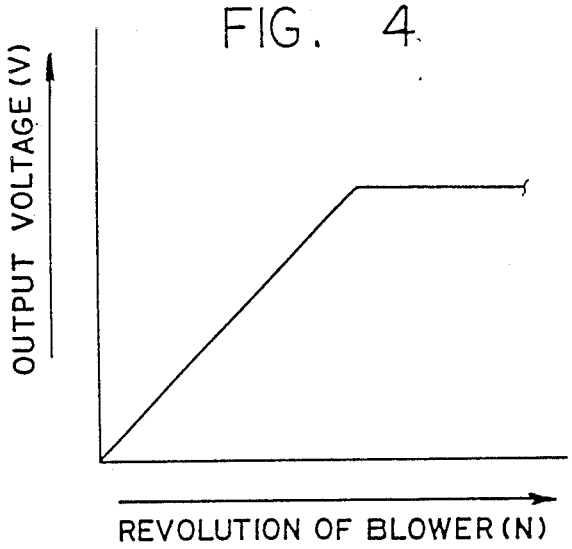
FIG. 4 is a graph showing the relationship between revolution of blower and output from the revolution detecting circuit.
Figure 5:
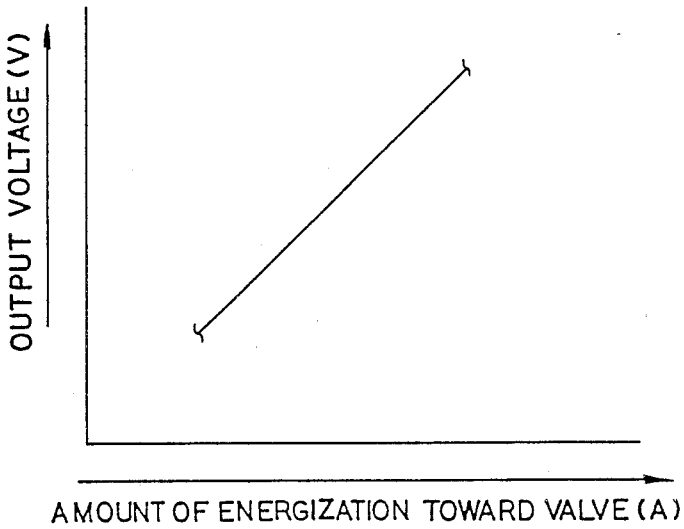
FIG. 5 is a graph showing the relationship between output of the revolution detecting circuit and electrical current supplied to a proportional directional valve.

The revolution detecting circuit 62 is comprised as shown in FIG. 3 by way of illustration. In the revolution detecting circuit 62, a brushless electric motor (not shown) is incorporated into the blower 33 in which a permanent magnet **33*b* is secured to a rotary shaft 33*a* of the motor. In addition to the magnet 33*b*, the revolution detecting circuit 62 has a Hall device 33*c*, a signal generator 62A which includes coils (CO1–CO4), an analogue switch means 62B, a decoder 62C, and a voltage transducer 62D. The transducer 62D changes its voltage (V) in proportion with the revolution (N) of the blower 33 within the range of a certain voltage as seen in FIG. 4. The proportional directional valve circuit 63 determines the amount of energization (A) toward the proportional directional valve 45 according to the output voltage (V) from the revolution detecting circuit 62 as seen in FIG. 5. The valve circuit 63 makes up for the amount of the energization toward the valve 45** so as to keep the ratio of air flow to gas fuel at the appropriate value.

OPERATION

With the structure thus far described, the electronic control circuit 5 works as follows: Operation of the knob 54 changes the reference voltage in response to the output from the water temperature sensor 53, so that the blower control circuit 61 instantaneously changes its output voltage so as to determine the revolution of the blower 33. The revolution change of the blower 33 varies the output voltage (V) of the revolution detecting circuit 62 so as to determine the amount of energization toward the proportional directional valve 45 in accordance with FIG. 5.

That is to say, the operation of the knob 54 substantially changes both the revolution of the blower 33 and the opening degree of the proportional directional valve 45 instantaneously, so that the hot water of desired temperature is quickly served. With the instantaneous change of both the opening degree of the valve 45 and the revolution of the blower 33, the amount of air from the blower 33 and that of fuel gas is maintained in appropriate proportion to always represent a normal air-fuel ratio.

In cases in which the air-fuel ratio may deviate from the normal value due to a change of component of the fuel gas, or increased flow through resistance such as at air inlet and outlet, the valve control circuit 63 works to compensate the opening degree of the valve 45. That is to say, with this case, the proportional directional valve 45 acts to decrease the opening degree, by making up for the amount of energization toward the valve 45 so as to return the output voltage (mV) of the thermocouple 52 back to the normal value.

Figure 6:
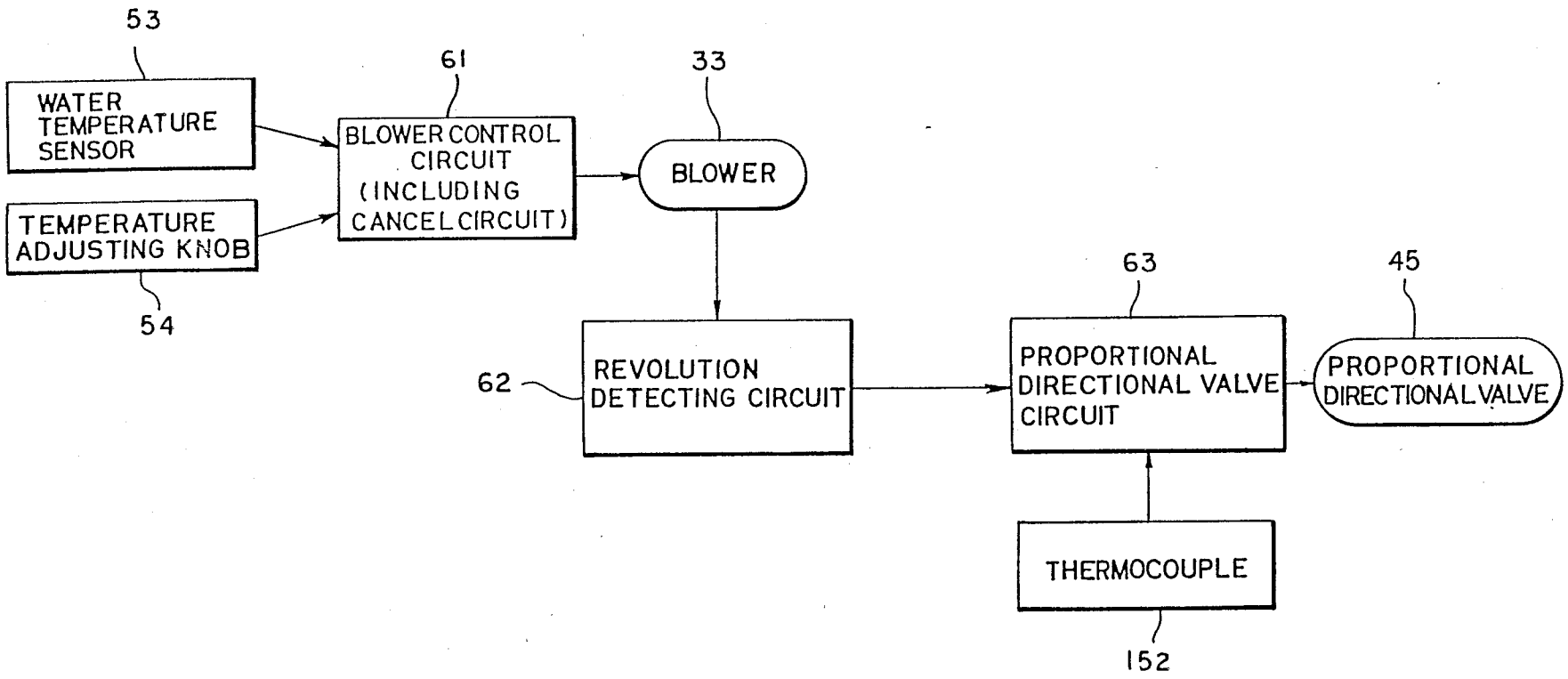
FIG. 6 is a block diagram of a control circuit according to a second embodiment of the invention.

Referring now to FIG. 6, a second embodiment of the invention is shown. In this embodiment, a blower control circuit 61 works to compensate the revolution of a blower 33 in response to the output from a thermocouple 152, in opposition to the first embodiment in which the proportional directional valve 45 is controlled at its opening degree in response to the output from the thermocouple 52. In this instance, the proportional directional valve control circuit 163 works to compensate the opening degree of a proportional directional valve 45 according to the output from the thermocouple 152, because a change of revolution of the blower 33 affects the opening degree of the valve 45 at the time of revolution compensation.

It is noted that a cancel circuit (not shown) is incorporated into the blower control circuit 61 to cancel the output from the thermocouple 52 for a certain period of time such as, for example, 10 seconds so as to obtain a stable output, and thus leading to avoiding malfunction of the air-fuel control at the time of igniting the fuel gas.

Instead of the hall device **33*c* as a means to detect the revolution of the blower 33**, a rotary encoder, a synchro resolver, a frequency generator or the like may be employed.

A pressure sensor may be used to detect the air pressure of the blower 33 at the lower reach thereof instead of detecting the revolution of the blower 33 when detecting the amount of air flow of the blower 33. In this instance, the amount of energization toward the blower 33 may be detected.

In the latter case, a delay circuit may be employed at the input or output terminal of the proportional directional valve control circuit 63 to change the opening degree of the valve 45 while the blower 33 is changing its revolution from low r.p.m. to high r.p.m., and vice versa.

This invention may be incorporated into air warming apparatus instead of water heating apparatus of the above embodiments. It is also appreciated that other kinds of fuel such as, for example, petroleum, may be employed instead of kerosene.

The invention has been described in various forms which are intended to be explanatory and not to be taken in a limiting sense, since various changes in the parts, construction and arrangement may be effected without departing from the scope of the invention as set forth in the following claims.

What is claimed is:

1. A burner apparatus comprising:

a housing;

a burner plate within said housing on which fuel gas is ignited;

a fuel supply which is in communication with said burner plate and is regulated by a proportional directional valve;

an air supply which is in communication with said burner plate and is regulated by a blower;

a temperature adjusting knob which provides output to a blower control circuit;

a thermal sensor which detects combustion on the burner plate and generates on output voltage proportional to the combustion;

a heat determining means remotely located from the burner plate which indirectly determines heat generation of the burner plate by measuring the heat imparted to at least a portion of a medium being heated by the burner plate and generates an output voltage to a blower control circuit;

a blower control circuit, which receives input signals from the thermal sensor, the heat determining means and the temperature adjusting knob, and which controls the blower in response to the input signals and including a cancel circuit which is incorporated into the blower control circuit to cancel the output from the thermal sensor for a predetermined period of time during initial ignition;

a revolution detecting circuit which determines revolutions of the blower and generates an output voltage; and a proportional directional valve control circuit which controls supply of fuel to the apparatus by regulating the proportional directional valve in response to the output voltages received from the revolution detecting circuit and the thermal sensor.

2. A burner apparatus according to claim 1 in which the thermal sensor is a thermocouple to detect the temperature of the flame on the burner plate to determine air-fuel ratio.

3. A burner apparatus according to claim 1, wherein the heat determining means is a water temperature sensor.

* * * * *